United States Patent [19]

Parracho et al.

[11] 4,402,146

[45] Sep. 6, 1983

[54] RUNNING SHOE SOLE WITH HEEL TABS

[75] Inventors: Rui M. Parracho, Peabody; Kevin J. Crowley, Newburyport, both of Mass.

[73] Assignee: Converse Inc., Wilmington, Mass.

[21] Appl. No.: 309,663

[22] Filed: Oct. 8, 1981

[51] Int. Cl.[3] ..... A43B 5/00; A43B 13/04; A43B 23/08

[52] U.S. Cl. ..... 36/129; 36/32 R; 36/69

[58] Field of Search ..... 36/129, 69, 89, 31, 36/32 R, 90

[56] References Cited

U.S. PATENT DOCUMENTS

| | | | |
|---|---|---|---|
| 202,409 | 4/1878 | Cambell | 36/69 |
| 706,551 | 8/1902 | Gordon et al. | 36/69 |
| 4,302,892 | 12/1981 | Adamik | 36/31 |
| 4,354,318 | 10/1982 | Frederick et al. | 36/69 |

FOREIGN PATENT DOCUMENTS

| | | | |
|---|---|---|---|
| 2033726 | 5/1980 | United Kingdom | 36/129 |

*Primary Examiner*—Patrick Lawson

*Attorney, Agent, or Firm*—Bromberg, Sunstein & McGregor

[57] ABSTRACT

An athletic shoe is provided with means for increasing lateral stability of the heel area to increase ankle stability and reduce the possibility of ankle fatigue due to misalignment of the ankle joint and the possibility of promotion or supination injury. The heel peripheral area of a midsole or heel lift portion is made of a harder material than the heel central area, and extensions of the outsole are provided at the sides of the heel portion to interconnect the outsole and a heel counter member to stabilize the heel counter, without inhibiting heel cushioning, and may be glued to a covering of the heel counter, and to the peripheral edges of the midsole and heel lift portions.

12 Claims, 6 Drawing Figures

RUNNING SHOE SOLE WITH HEEL TABS

This application relates to the field of footwear. In particular, this application relates to an athletic shoe with lateral stabilizing means to reduce ankle bending upon impact.

BACKGROUND OF THE PRIOR ART

In the area of footwear intended for use by infants, who have weak ankles, and athletes, whose ankles may be weakened by fatigue, there have been numerous changes and modifications made in the heel area of shoes to reduce the tendency of the wearer's ankle to bend sideways upon impact of the heel at the start of each stride. To reduce excessive bending, known as pronation when the foot deflects inwardly, the most common direction, and known as supination when it bends in the opposite direction, and to reduce the incidence of the resulting injury, various means have been proposed.

The concept involved is to increase the lateral stability of the shoe to prevent it from bending about its roll axis. This has been done by making the U-shaped periphery of the heel area of a shoe of a harder rubber or like material than the middle of the heel area, or by the equivalent means of placing pins or plugs of harder material around the heel periphery area of a shoe layer such as a midsole or heel wedge area, or by the inverse method of placing either holes or plugs of softer material in the center of the heel area of such a layer. Stiff plastic plates have been placed horizontally between layers at the heel of a shoe to reduce differential compression of inner and outer heel edges upon heel impact. Cardboard inserts or insoles have been provided with a pattern of slits at the center of the heel area, such as slits in a radial pattern from a common center, to make the center less stiff than the sides.

Also, in an attempt to insure that the shoe itself impacts squarely, which may help maintain the wearer's ankle in the proper locked position, the heel area of the outsole has been extended sideways and rearward beyond the body of the shoe, forming a large flat initial impact area. The high stresses imposed on the shoe structure itself by this extension tend to cause delamination of layers of the shoe structure. To avoid this delamination, such shoes include an upward extension of the rubber of the outsole around the periphery of the heel area, bonded to the heel wedge or lift layer and to the midsole layer, and terminating with a thin, blended edge at the heel counter pocket. This upward extension is tapered in thickness, being thickest where stresses are highest, adjacent the outward extension of the sole, and thinnest where it blends into the heel counter pocket. It is partially glued to the heel counter pocket, but no adhesive is applied to its uppermost extension, to avoid extrusion of adhesive over the blend line and extends only far enough to resist outsole and heel lift or wedge delaminating forces and provide a smooth blending into the surface of the heel counter pocket. To the extent that this upward extension may slightly increase lateral stability of the shoe heel, it detracts from the ability of the rear heel area of the shoe to absorb and cushion the shock of initial heel impact, causing fatigue and thus tending to increase the tendency toward injurious pronation of the wearer's ankle. The instant invention avoids these and other deficiencies of the prior art.

SUMMARY OF THE INVENTION

The instant invention provides an athletic shoe having increased lateral stability without degradation of its ability to cushion the shock of heel impact upon the start of a wearer's stride.

Thus, it is a primary object of the invention to provide lateral stabilization means for an athletic shoe. It is a feature of the invention that the lateral stabiliation means are tabs extending from the outsole of the shoe to the heel counter of the shoe, on opposite sides of the shoe, to resiliently connect the outsole to the heel counter. It is an advantage of the invention that the lateral stability of a shoe may be improved without adversely affecting the shock absorbing characteristics of the shoe.

It is a further objective of the invention to provide lateral stabilization means for an athletic shoe which may be added to a conventional athletic shoe to improve its lateral stability. It is a further feature of the invention that the stabilizing means may be provided in the form of integral tab extensions of the outsole of an athletic shoe on opposite sides of the heel area of the shoe, extending from the outsole to the heel counter, and being bonded to the heel wedge layer, midsole layer and heel counter. It is an advantage of the invention that lateral stabilization means according to the invention are external to the shoe, and may be incorporated in a shoe without changing any other desirable feature of the shoe.

DESCRIPTION OF THE PREFERRED EMBODIMENT

Figure 1:
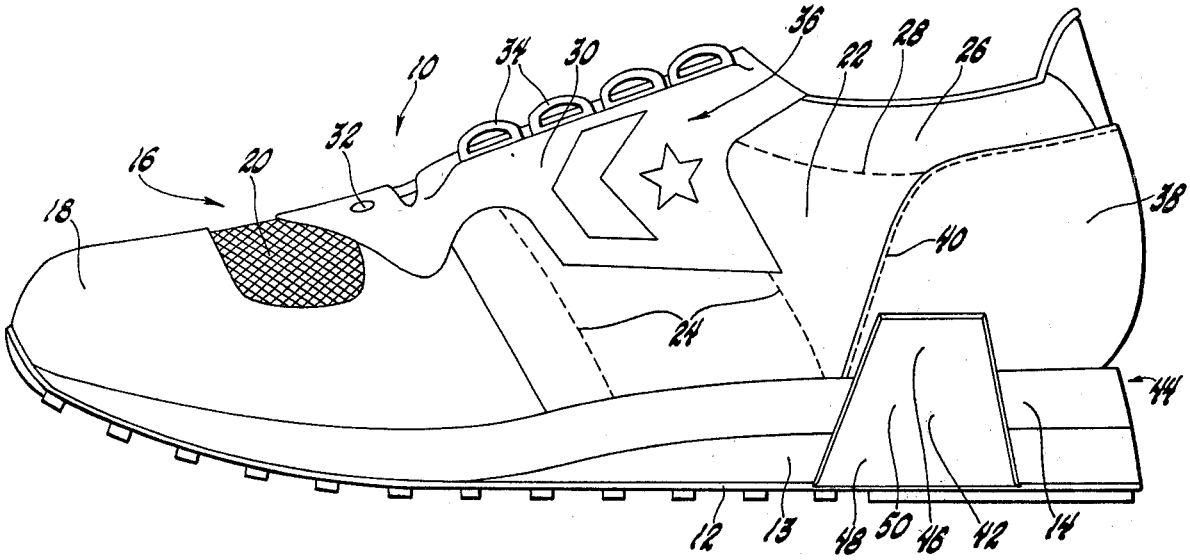
FIG. 1 is a side elevational view of an athletic shoe incorporating the preferred embodiment of the invention.

FIG. 1 shows an actual commercial embodiment of an athletic shoe according to the invention.

The depicted shoe 10 is of slip-last construction, for the lightest possible weight, and includes an outsole portion 12, a heel lift portion 13, a midsole portion 14 and an upper portion 16. Upper portion 16 includes a toe cap portion 18, preferably of suede leather for durability, although other materials may also be utilized, and includes a mesh area 20 for ventilating purposes. Shoe 10 further includes an instep and heel area 22, preferably covered in a nylon material, and having interior instep padding, not shown, retained by stitches 24. A padded ankle opening area 26 is defined by stitching 28. Shoe 10 further includes a lacing area 30, preferably covered with a suede leather, and provided with holes 32 and a plurality of loops 34 for receiving a shoe lace, not shown, as well as a source-indicating indicia such as indicia 36.

Figure 4:
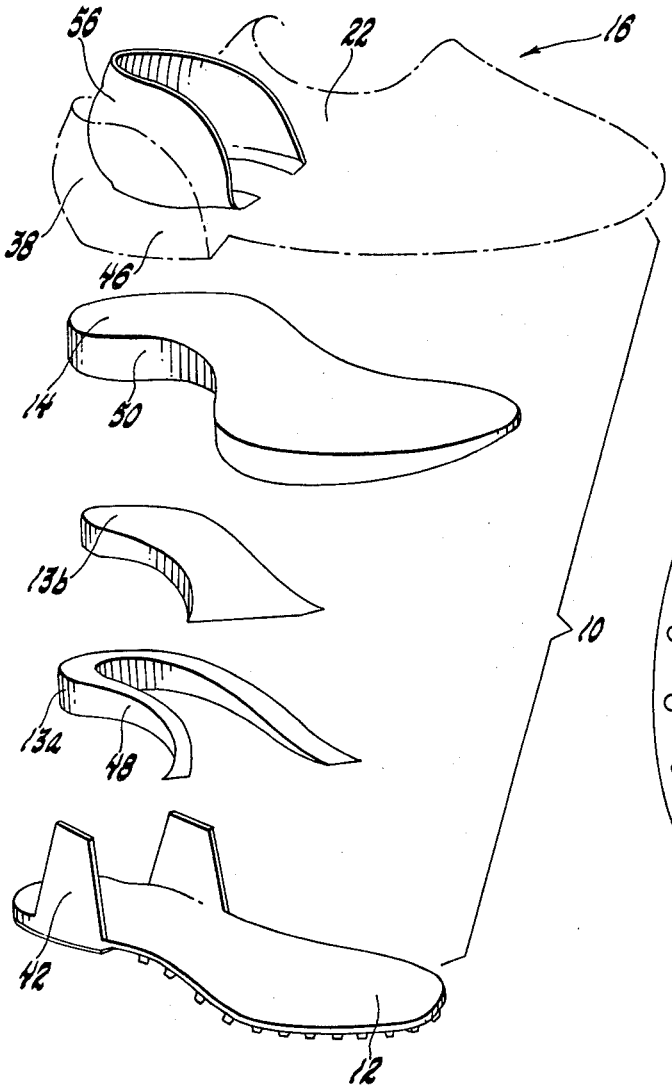
FIG. 4 is an exploded view depicting the sole and heel area construction of an athletic shoe according to the preferred embodiment shown in FIG. 1.

At the rear of shoe 10 is a stiff plastic heel counter member, best shown in FIG. 4, adhesively attached to midsole portion 14 and captured in a pocket formed by instep and heel area portion 22 and a heel counter portion 38, preferably of a suede leather for strength and durability. The heel counter member and heel counter portion 38 are made unitary such as by the use of adhesive, and assembled to instep and heel area portion 22 by stitches 40.

To reduce the possibility that a wearer's ankle will be forced from its normal position, possibly causing injury, upon impact of the heel at the beginning of a stride, tab means 42 are provided, resiliently interconnecting the outsole portion 12 and heel counter portion 38. It should be noted that tab means 42 may be directly connected to a heel counter member, but are connected to heel counter portion 38, since adhesion of tab means 42 to the suede leather of heel counter portion 38 is better than its adhesion to a plastic heel counter member using conventional adhesives.

It is essential that tab means 42 interconnect outsole portion 12 with heel counter portion 38 on opposite sides of the heel area of a shoe such as shoe 10, and advantageous, although not absolutely necessary, that tab means 42 also be firmly adhesively attached to heel lift portion 13 and midsole portion 14. The adhesive bond formed between tab means 14 and heel lift portion 13 and midsole portion 14 tends to prevent compression of these shoe layers near the area of adhesion to heel tab means 42, thus further increasing the lateral stability of shoe 10. It is further desirable that tab means 42 be relatively narrow, defining an interval around the back of the heel of the shoe, so that tab means 42 will not have the harmful affect of inhibiting cushioning of heel impact at heel rear area 44.

Figure 2:
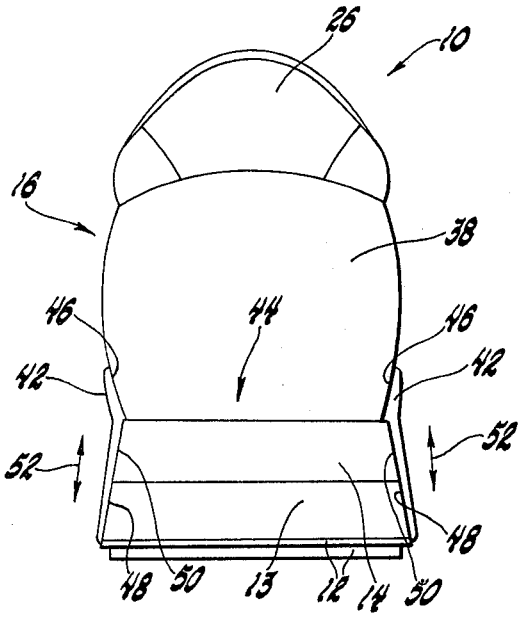
FIG. 2 is a rear elevational view of the preferred embodiment of an athletic shoe as depicted in FIG. 1.

Referring to FIG. 2, a rear view of the shoe shown in FIG. 1 is illustrated. As shown, tab means 42 interconnect outsole portion 12 and heel counter portion 38, preferably being an integral extension of outsole portion 12, and being adhesively bonded to heel counter portion 38 at areas 46. Tab means 42 may also advantageously be bonded to heel lift portion 13 and midsole portion 14 at areas 48 and 50, respectively.

Thus, as can be seen, tab means 42 resist motion in the direction shown by arrows 52 between outsole portion 12 and heel counter portion 38 adjacent tab means 42, without interferring with the compression of heel lift portion 13 and midsole portion 14 at heel rear area 44 under the shock of initial impact when running. As illustrated, tab means 42 have a constant thickness of 0.12 inches (0.304 cm) although, as will be apparent, tab means 44 may be made in any convenient thickness. However, tab means 44 should resiliently increase the lateral stability of shoe 10 without becoming so stiff as to negate the desirable shock absorbing characteristics in the areas of heel lift portion 13 and midsole portion 14 adjacent tab means 42.

Figure 3:
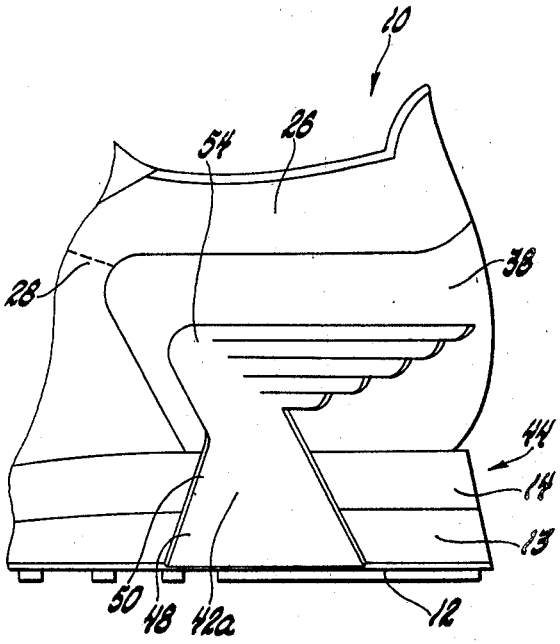
FIG. 3 is a partial side elevational view of an athletic shoe, showing a second decorative embodiment of the invention.

As will be apparent from FIG. 3, tab means 42 may be made in a decorative form with no deleterious effect on function. In FIG. 3, tab means 42*a* are shown as provided with an upward and rearward extension 54, in the form of a stylized representation of a wing and feathers.

Numerous other decorative variations are also believed possible without departing from the spirit and scope of the invention.

FIG. 4 depicts an exploded schematic perspective view of a portion of the structure of shoe 10. As shown, tab means 42 are an integral extension of outsole portion 12, preferably molded of a rubber material having a hardness of about 68 when measured with a conventional type A durometer. Also as shown heel lift portion 13 includes a U-shaped heel lift or heel wedge outer portion shown as heel lift horseshoe 13*a* and heel lift central or inner portion 13*b*. In the preferred embodiment, heel lift horseshoe 13*a* is made from an expanded plastic foam material having a hardness of 60±5 when measured on a conventional type C durometer. Heel lift central portion 13*b* is made of a similar material, having a hardness of 50±5 when measured on a conventional type C durometer. Midsole portion 14, in the preferred embodiment, is also made of an expanded plastic foam material having a hardness of 50±5 when measured on a type C durometer. Heel counter member 56, in the preferred embodiment, is formed from a stiff material such as a polyvinyl chloride plastic.

Figure 6:
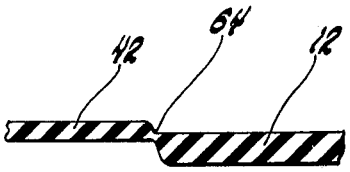
FIG. 6 is a partial sectional view taken along line 6—6 in FIG. 5.
Figure 5:
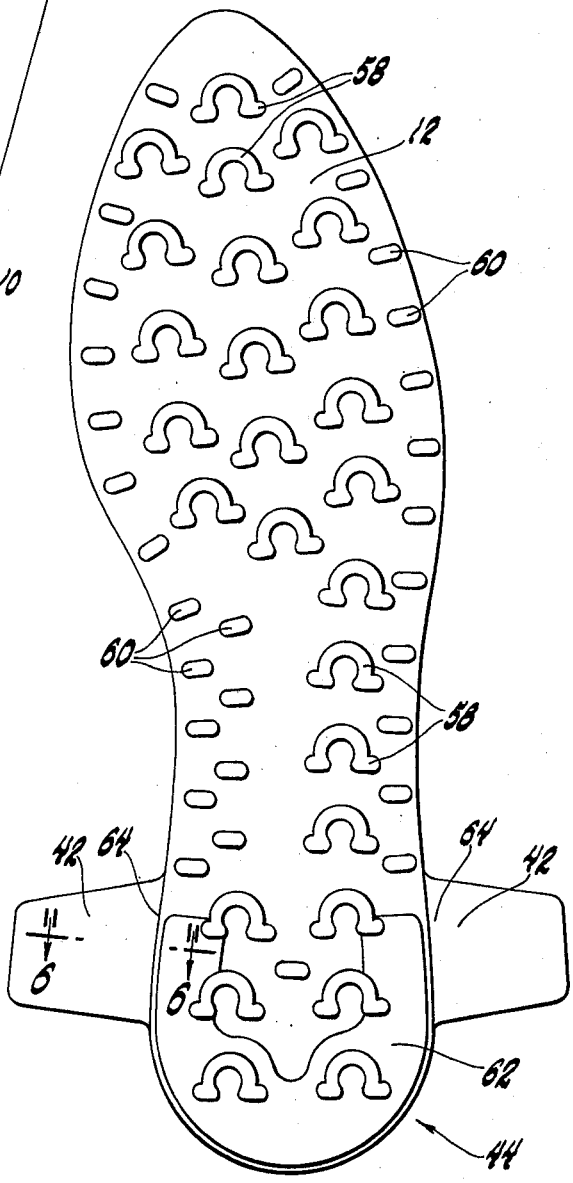
FIG. 5 is a plan view of an outsole for an athletic shoe according to the preferred embodiment of the invention.

As shown in FIGS. 5 and 6, tab means 42 are preferably formed as integral extensions of outsole portion 12 and are formed together with the remainder of outsole portion 12. As shown, outsole portion 12 has a plurality of first raised portions 58, each defining a rearward-opening shape, and a plurality of second raised areas 60 in the form of laterally extending pins or pegs. Adjacent heel rear area 44 a raised area 62 is provided, primarily to increase the wear resistance of the heel area of outsole portion 12. In the preferred embodiment, tab means 42 are initially formed in the same plane as the remainder of outsole portion 12, and subsequently folded at hinge area 64 after outsole portion 12, heel lift portions 13*a* and 13*b*, midsole portion 14 and upper portion 16 have been fastened or bonded together, such as by use of a urethane cement. Tab means 42 are then adhesively bonded, preferably with a urethane cement, to heel lift horseshoe 13*a*, midsole portion 14 and heel counter portion 38. As will be apparent, it is also believed feasible, although not as desirable, to form tab means 42 separately for subsequently bonding to outsole portion 12 and heel counter portion 38.

As will be apparent, numerous modifications and variations may be made to the disclosed embodiments of the invention, without departing from the spirit and scope of the invention.

We claim:

1. An athletic shoe, comprising:

an outsole portion;

a heel lift portion fastened to said outsole portion;

a midsole portion fastened to said outsole portion and to said heel lift portion;

an upper portion fastened to said midsole portion and including a heel counter portion;

lateral stabilization means fastened to said outsole portion and to said heel counter portion for resiliently opposing compressive forces in the midsole and heel lift portions of the shoe at the edge of the front of the heel area;

said lateral stabilization means being disposed on opposite sides of said shoe adjacent opposite sides of said heel counter portion and defining an interval therebetween, said interval extending around a rear heel portion of said shoe.

2. An athletic shoe according to claim 1, wherein:

said lateral stabilization means includes first and second heel tab means firmly bonded to said portions of said heel lift portion, said midsole portion and said heel counter portion;

said heel tab means being integral extensions of said outsole portion.

3. An athletic shoe according to claim 2, wherein:

said heel lift portion includes an inner portion and an outer portion, said outer portion being a U-shaped portion surrounding a portion of said inner portion, said first and second heel tab means being bonded to said outer portion.

4. An athletic shoe, comprising:

an outsole portion, said outsole portion being formed of molded rubber;

a heel lift portion, said heel lift portion being formed of expanded plastic foam;

a midsole portion, said midsole portion being formed of expanded plastic foam;

an upper portion, said upper portion including a heel counter portion;

said outsole portion being bonded to said heel lift portion and to said midsole portion;

said heel lift portion being bonded to said midsole portion;

said midsole portion being bonded to said upper portion;

a pair of heel tab members, said heel tab members being disposed on opposite sides of said shoe adjacent said heel counter portion;

each said heel tab member resiliently interconnecting portions of said outsole portion, said heel lift portion, said midsole portion and said heel counter portion;

said heel tab members being integral extensions of said outsole portion and being firmly bonded to said heel lift portion, said midsole portion and said heel counter portion.

5. An athletic shoe according to claim 4, wherein:

said heel lift portion includes an inner portion and an outer portion, said outer portion being a U-shaped portion surrounding a portion of the periphery of said inner portion and being fabricated of an expanded plastic foam having a greater hardness than the expanded plastic foam forming said inner portion.

6. An athletic shoe according to claim 4, wherein:

said pair of heel tab members define a pair of decorative shapes in the form of wings and feathers.

7. An athletic shoe, comprising:

an outsole;

a midsole fastened to the outsole;

an upper fastened to the midsole and including a heel counter portion; and lateral stabilization means, external to the midsole, including a heel tab extending from the outsole and firmly bonded to the edge of the midsole commencing at a point forward from the rearmost point of the shoe and extending forward to the front heel area thereof, and having greater hardness than the adjacent portion of the midsole, for resiliently resisting local edge compression of the midsole.

8. An athletic shoe according to claim 7, wherein the heel tab is an integrally formed extension of the outsole.

9. An athletic shoe according to claim 8, wherein the lateral stabilization means includes a heel tab bonded to the midsole at an inner front edge of the heel area thereof.

10. An athletic shoe according to claim 7, wherein the lateral stabilization means includes a pair of heel tabs disposed on opposite sides of the midsole at the front edges of the heel area thereof.

11. An athletic shoe according to claim 7, wherein the heel tab extends from the outsole to the heel counter portion and is bonded to an outside surface thereof.

12. An athletic shoe according to claim 11, wherein the heel tab is an integrally formed extension of the outsole.

* * * * *